US006718874B2

(12) United States Patent
Gross

(10) Patent No.: US 6,718,874 B2
(45) Date of Patent: Apr. 13, 2004

(54) APPARATUS AND METHOD FOR ELIMINATING DOT GAIN IN FLEXOGRAPHIC PRINTING SYSTEMS

(76) Inventor: Lawrence W. Gross, 1065 S. Rogers Cir., Boca Raton, FL (US) 33487

( * ) Notice: Subject to any disclaimer, the term of this patent is extended or adjusted under 35 U.S.C. 154(b) by 0 days.

(21) Appl. No.: 09/992,627

(22) Filed: Nov. 6, 2001

(65) Prior Publication Data

US 2003/0084803 A1 May 8, 2003

(51) Int. Cl.[7] ..... B41N 1/00

(52) U.S. Cl. ..... 101/395; 101/401.1; 101/401; 430/306; 430/396; 430/394

(58) Field of Search ..... 101/395, 401.1, 101/401; 430/306, 396, 394

(56) References Cited

U.S. PATENT DOCUMENTS

| | | | | | |
|---|---|---|---|---|---|
| 3,651,759 | A | * | 3/1972 | Ritzerfeld | 101/395 |
| 3,874,945 | A | * | 4/1975 | Misek | 430/310 |
| 4,046,071 | A | * | 9/1977 | Mizuno et al. | 101/395 |
| 4,101,324 | A | * | 7/1978 | Mizuno et al. | 430/306 |
| 4,152,986 | A | * | 5/1979 | Dadowski et al. | 101/463.1 |
| 4,268,612 | A | * | 5/1981 | Misek | 430/306 |
| 4,283,484 | A | * | 8/1981 | Fairhead et al. | 430/306 |
| 4,289,071 | A | * | 9/1981 | Hallman et al. | 101/395 |
| 4,610,950 | A | * | 9/1986 | Milliken | 430/306 |
| 5,275,919 | A | * | 1/1994 | Kawatsuji et al. | 430/306 |
| 5,396,841 | A | * | 3/1995 | Guls | 101/395 |
| 5,994,026 | A | * | 11/1999 | DeBoer et al. | 430/270.1 |
| 6,223,655 | B1 | * | 5/2001 | Shanbaum et al. | 101/395 |

FOREIGN PATENT DOCUMENTS

| | | | | |
|---|---|---|---|---|
| DE | 4324577 C1 | * | 12/1994 | B41D/07/00 |
| DE | 19503951 A1 | * | 8/1996 | B41C/01/00 |

* cited by examiner

*Primary Examiner*—Andrew H. Hirshfeld
*Assistant Examiner*—Andrea H. Evans
(74) *Attorney, Agent, or Firm*—John C. Smith

(57) ABSTRACT

A very low percentage dot screen is formed on a flexographic plate which prevents the severe compression normally found adjacent to zero percent areas of the flexographic plate. The dot screen reduces dot gain by distributing the compressive force of the flexographic printing plate on the printing surface. The total area of the dot screen is kept to a very low percentage of the total surface area being printed so that it will not alter perceived color.

20 Claims, 6 Drawing Sheets

Prior Art

Prior Art

APPARATUS AND METHOD FOR ELIMINATING DOT GAIN IN FLEXOGRAPHIC PRINTING SYSTEMS

BACKGROUND OF THE INVENTION

1. Technical Field

The present invention relates to printing systems. In particular, it relates to improved flexographic printing plates which improve print quality by minimizing dot gain in flexographic printing systems that is caused by the compression of the flexible dots used to form the images on the flexographic plates.

2. Background Art

The commercial printing industry uses several technologies. The first technology is offset lithography, commonly referred to as offset printing. The offset printing process begins with the authors who create the written material, either actual or graphic, which is intended to be placed in the ultimate printed material. Once these materials are created, they are typically compiled into an electronic file. Once the electronic file is created, it is used to create a plate which holds an image of the data. Offset printing uses metal plates to create images. (NOTE: Older offset technology used a film negative as an intermediate step between the computer and generating a plate.)

So far, the plates have been referred to as "metal" plates for ease of discussion. However, those skilled in the art will recognize that the rigid plates used in this type of lithography can be manufactured from a variety of materials ranging from high-quality aluminum at one end of the spectrum to a low quality material, such as paper, at the other end of the spectrum. The plate material selected will depend on the nature of the ultimate printed material. For example, high-quality printing, such as that used in books containing art reproductions, will require that a high-quality plate material be used. For the purpose of this disclosure, the term metal plates will be used to describe any rigid plate material.

Once the image is transferred to the metal plate, the metal plate is pressed against a "blanket" plate, which is typically made from a rubber or rubber-like material, and then transferred from the blanket plate to the paper. The paper is then dried in an oven and then chilled to set the ink so that it will not smudge.

In four color process printing, typically four plates are used, each plate using either red, blue, yellow or black. The use of multiple plates to create a single image requires substantial care to be made in registering and aligning the plates to ensure that the final printed image is crisp and clear. This is typically accomplished through the use of skilled press personnel.

Metal plates provide several advantages to a printer. The most important of these advantages is the high print quality which metal plates provide. The print quality provided by metal plates is very good because of the rigid nature of the metal plates. When metal plates are pressed against a print surface, the metal plates have sufficient strength and rigidity to prevent them from deforming. In turn, the resistance to deformity provides superior print quality.

A second technology used for many print applications is known as flexographic printing. Flexographic printing is a direct printing method rather than an offset printing method. Flexographic plates are typically engraved plates containing relief images which are cut into flexible plates made from rubber, photopolymer, or any other suitable flexible material. Flexography has an advantage over offset lithography in that it can print on practically any surface material. It can use fast drying inks which allow it to be used to print on what would otherwise be a difficult surface for a traditional print method such as offset lithography.

While flexographic printing provides several advantages over offset lithography, such as the ability to print on surfaces which may not be suitable for offset lithography, it also has a disadvantage in that it does not have the print quality of offset lithography in certain situations. In particular, the flexible material, which forms the flexographic plate, experiences significant compression as the dot screen percentage drops below ten percent. This is particularly apparent when the low percentage dots are adjacent to areas containing no dots. As the dot is deformed, it flattens and forms an expanded print area. This condition is commonly referred to as dot gain. The expanded print area caused by the deformed dot results in an excessive amount of ink being applied to the print surface, which in turn results in defects in the print such as darker areas or defects in coloration. It would be desirable to have a method of eliminating or reducing defects in the printed material due to dot deformation such that flexographic printing could produce print quality similar to offset lithography.

While addressing the desirability of using flexographic printing, the prior art has failed to provide a method of manufacturing flexographic plates, and a method of using flexographic plates which would minimize quality defects created by dot gain that is produced by dot deformation in the flexographic plates.

SUMMARY OF THE INVENTION

The present invention solves the foregoing problems by providing a very low percentage dot screen on a flexographic plate that prevents the plate from having the severe compression normally found adjacent to zero percent areas of the flexographic plate. The low percentage dot screen provides multiple dot screen points in the recessed areas of the flexographic plate and reduces dot gain by distributing the compressive force of the flexographic printing plate on the printing surface. The total area of the dot screen is a very low percentage of the total surface area being printed, and will not alter perceived color. The dot screen does not have a noticeable effect on color, and substantially reduces the dot gain inherent in flexographic plates.

DESCRIPTION OF THE PREFERRED EMBODIMENT

Figure 1:
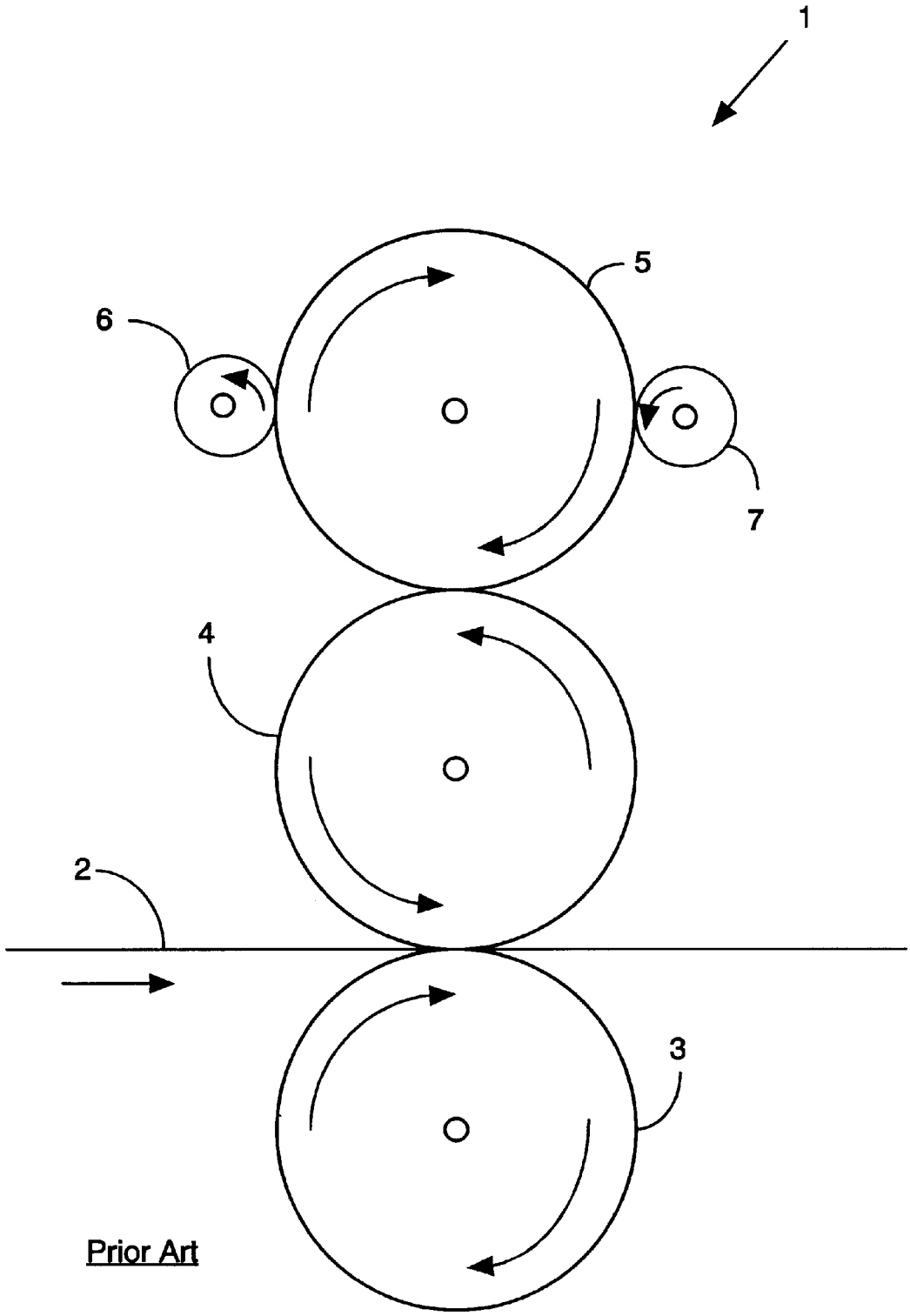
FIG. 1 is an illustration of a prior art lithographic offset printing process.

Referring to FIG. 1, this figure illustrates a side view of a prior art offset lithography process 1. After a page has been designed, the computer generates the printing plate 5. Once treated, the printing plate 5 has water applied via water applicator 6, and then has ink applied via ink applicator 7. Since water and ink will not mix, the areas of the printing plate 5 which were treated to allow water to adhere will not accept the ink. The ink is then applied solely to the areas of the printing plate 5 which are not carrying water. Once the printing plate 5 passes the ink applicator 7 it carries a layer of ink that reproduces the image from the film negative.

This process is referred to as offset printing because the printing plate 5 never comes in contact with the paper 2. Interposed between the printing plate 5 and the paper 2 is a rotating blanket plate 4 which transfers the image from the printing plate 5 to the paper 2. The blanket plate 4 typically made from pliant material, such as rubber. As the blanket plate 4 comes in contact with the rotating printing plate 5, the ink is transferred from the printing plate 5 to the blanket plate 4. Then, as the blanket plate 4 rotates, it presses against the paper 2 which is supported by a support roller 3. When the blanket plate 4 comes in contact with the paper 2, the ink is then transferred to the paper 2.

Flexographic printing differs from offset lithography in several regards. First, the image does not require an intermediary blanket plate 4. Instead, the image is transferred directly from the flexographic printing plate to the paper. Second, the flexographic printing plate can be created using several processes. For example, it can be created using laser edging, or chemical treatment. The resulting finished plate contains a raised image which will apply ink to the printing surface. The areas which are not to be printed are recessed below the surface of the printing areas. Third, the rigid structure of the printing plate 5 used by offset lithography systems has historically provided better quality images because the physical strength of the rigid structure reduces the possibility of dot gain which creates distortion in the ultimate printed images.

Historically, flexographic printing has not been able to match the print quality of offset lithography because the flexible nature of the flexographic printing plate creates the printing effect known as dot gain. Dot gain occurs when an area with a low percentage of print image is compressed due to pressure created when the flexographic printing plate is pressed against the printing surface. When the flexible material in the flexographic printing plate is compressed it will expand outward under pressure. As a result, dots which were intended to be a specific size may be substantially extended in size due to lateral extension of the raised dot on the surface of the flexographic printing plate. In fact, the dot gain created by isolated points on the flexographic printing plate may be as much as 600 percent. With dot gains as substantial as this, visible spots may be unintentionally created across wide areas of an image. The dot gains may appear as color distortions, shadows, etc. These unwanted effects created by dot gain act to reduce the usefulness of flexographic printing technology for printing applications which require high-quality. This results in the need to use other, potentially more expensive, technologies such as offset lithography.

Figure 2A:
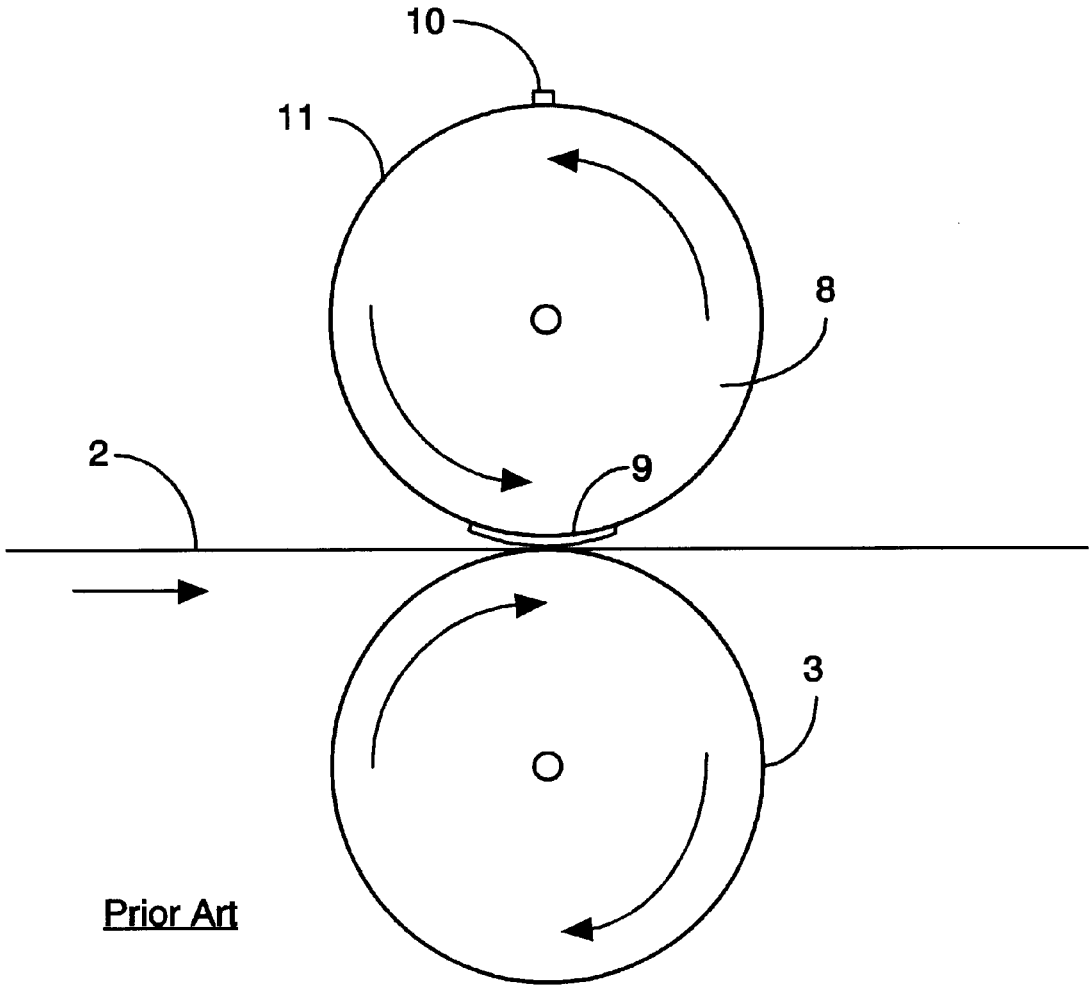
FIG. 2A is an illustration of a prior art flexographic printing process with a large dot segment being compressed against the print surface and a small dot segment not in contact with the print surface.

In FIG. 2A, a prior art flexographic printing process 8 is illustrated. For ease of discussion, the inking process which applies ink to the flexographic printing plate 8 prior to transfer to the printing surface 2 has been omitted. In this illustration, the flexographic printing plate 8 has a large raised segment 9 and a small raised segment 10 which transfer ink to the printing surface 2 when they come in contact with the printing surface 2. In addition to the raised statements, there is also a zero percentage area 11 on the flexographic printing plate 8. This zero percentage area 11 does not come in contact with the printing surface 2 and does not transfer ink to it.

As this figure shows, when large raised segment 9 is compressed against printing surface 2, the effects of dot gain are minimal due to the relatively large area covered by large raised segment 9. While the compression which occurs during the printing process may cause some lateral expansion of the flexible material which large raised segment 9 is fabricated from, the relative change in overall size (i.e. the dot gain) of large raised segment 9 is minimal.

Figure 2B:
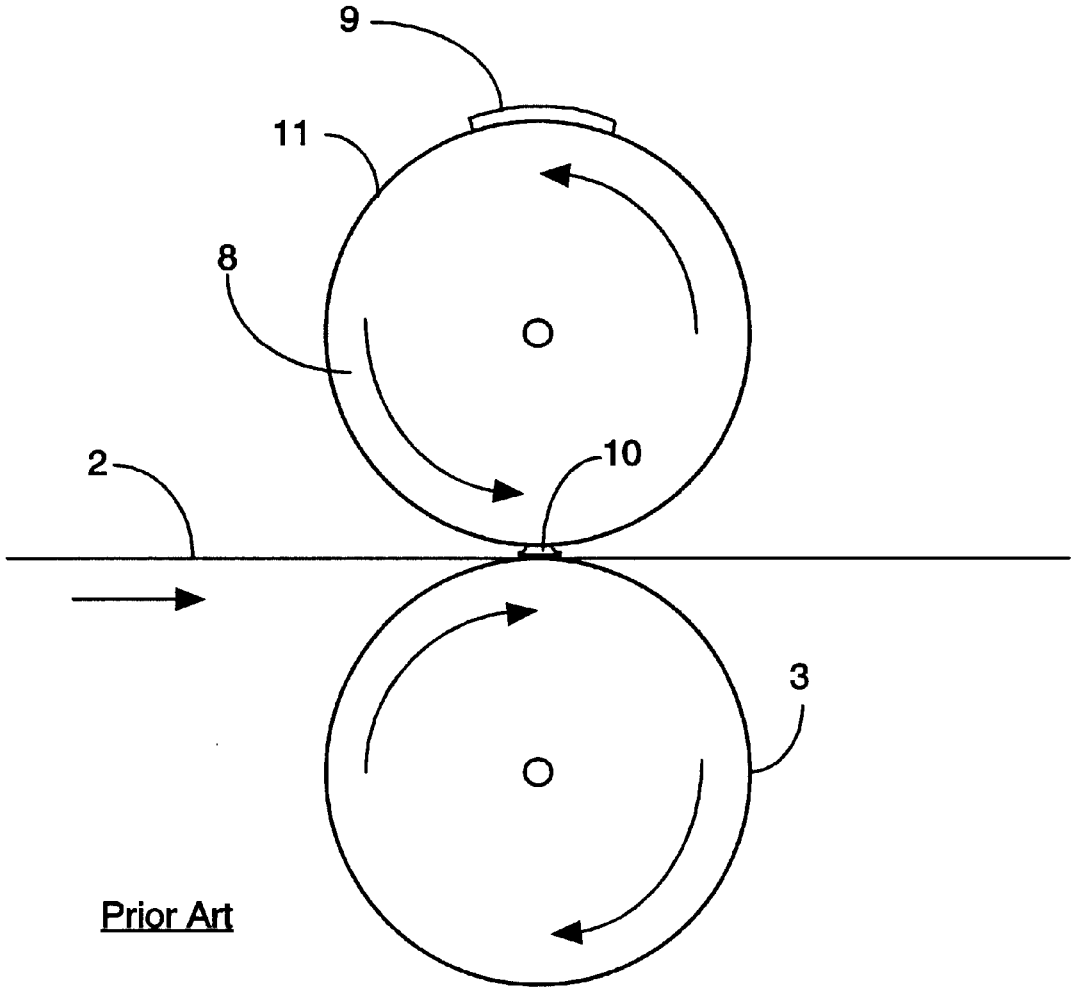
FIG. 2B is an illustration of a prior art flexographic printing process with a small dot segment being compressed against the print surface and creating a substantial dot gain.

FIG. 2B illustrates the adverse effect of increases in dot gain as the relative size of the print area decreases. In this figure, small raised segment 10 is being compressed against print surface 2. Since small raised segment 10 is fabricated from pliant material, as it is compressed it expands laterally. This lateral expansion is called dot gain. Unlike the large raised segment 9, the dot gain of small raised segment 10 is substantial on a percentage basis. In fact, the dot gain can be as high as 600 percent for a small raised segment 10 on a flexographic printing plate 8. This can substantially increase the area on print surface 2 where ink is applied. Due to this substantial increase, errors in coloration, darkness, contrast, etc, can be injected into the image being printed on the print surface 2.

The dot gain is produced when small areas of the flexographic printing plate 8 absorb the pressure produced during the print process. The smaller the area which absorbs the pressure, the greater compression on those areas, and the greater the dot gain due to the lateral expansion of those areas. As a result of the dot gain, reduced print quality occurs in flexographic printing. This causes many applications which require high print quality to use alternative print methods such as offset lithography. As discussed above, offset lithography uses rigid plates which do not deform under pressure. Flexographic printing uses pliant, deformable plates which create the dot gain errors that do not occur with offset lithography.

Figure 3:
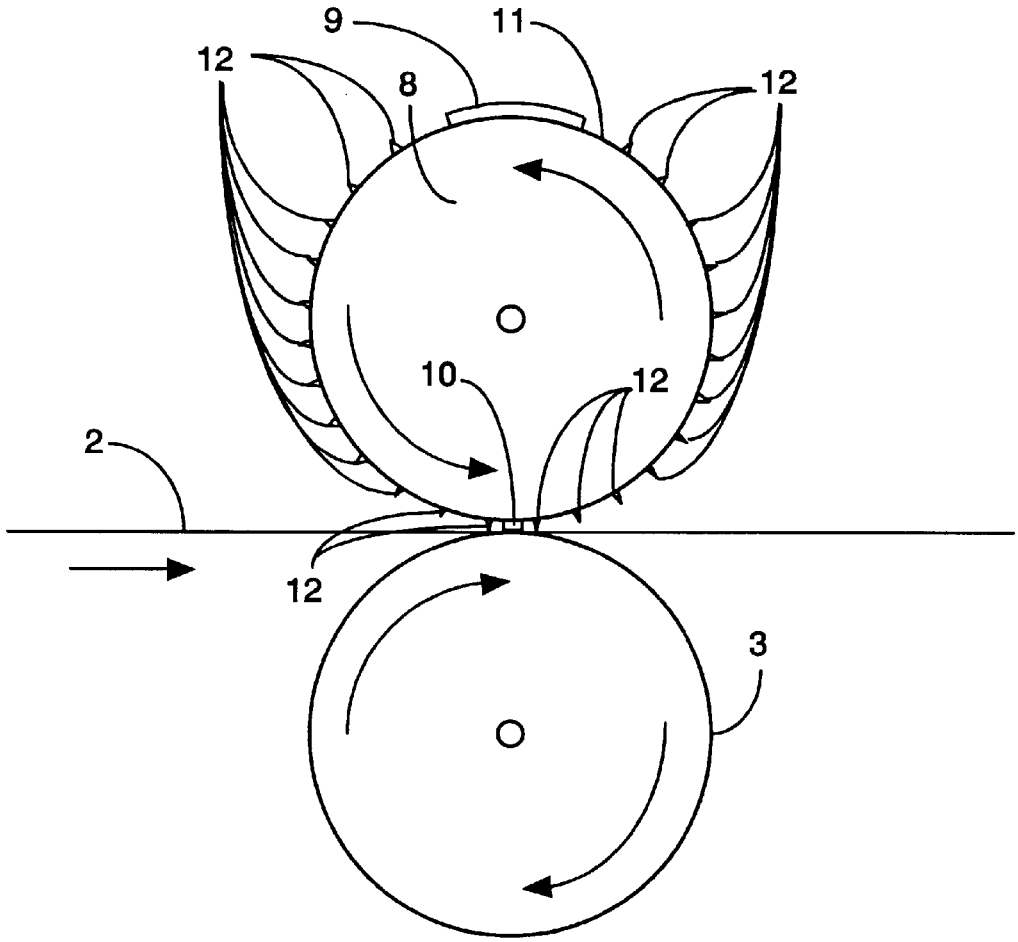
FIG. 3 is an illustration of a preferred embodiment of the invention in which a low percentage dot screen is used to prevent excess compression of a small dot segment to minimize dot gain.

In FIG. 3, a solution to the dot gain problem is provided. When manufacturing the actual flexographic printing plate 8, unwanted plate material is removed leaving behind a series of small and large shapes, namely the large raised segments 9 and the small raised segments 10 discussed above, which are used to create an image on the print surface 2. In high-quality, four color process printing, the remaining shapes on the flexographic printing plate 8 are a series of small dots. As discussed above, the flexographic printing plate 8 is fabricated from pliant material that is pressed against the print surface 2, which is usually paper, during the printing process. Due to the pliant nature of the flexographic printing plate 8 material, the individual dots are compressed resulting in increased dot sizes. This distortion, which can result in dot size increases of up to 600 percent, is generally referred to as dot gain. The dot gain distorts the printing and results in inferior print quality.

Dot gain is not consistent across an entire flexographic printing plate 8. In fact, dot gain generally increases as dot density decreases. This phenomenon is the result of the pressure exerted by the printing surface 2 against the surface of the flexographic printing plate 8 being applied to a decreasingly small area of raised segments 9, 10. As a result, the worst dot gains occur in low percentage areas adjacent to where the printing percentage drops off to zero percent. In fact, the gains in the areas adjacent to zero percent sections can approach 600 percent as the dots experience severe compression.

Lithographic offset printing is not subject to the dot gain problems inherent in flexographic printing as the middle plates have none of the compression problems inherent in the pliable plates used by flexographic printing systems. As a result, prior to the invention, lithographic offset printing was considered superior to flexographic printing. This invention allows flexographic printing systems to produce printed output equal in quality to lithographic offset printing.

The invention minimizes the dot gain problems experienced by prior art flexographic printing systems by providing a very low percentage base dot screen. In the preferred embodiment, the low percentage dot screen is under fifteen percent. However, the exact percentage of dot screen may vary while achieving suitable results depending on the material used to fabricate the flexographic printing plate 8 and the amount of pressure applied by the flexographic printing plate 8 to the printing surface 2 during the printing process. Depending on the dot gain characteristics of the flexographic printing plate 8 material and the applied pressure, the dot screen may occupy as little as one percent or as much as fifteen percent of the area of the zero percent area. However, in practice it has been found that a range of five to thirteen percent dot screen typically produces suitable results.

The low percentage dot screen has virtually no effect on perceived color on the print surface 2. The advantage provided by the dot screen is that while color change is not perceptible, the dot screen protects the flexographic printing plate 8 from the severe compression previously experienced near the zero percent areas. In addition, the dot screen typically reduces the dot gain in all other areas. This results in flexographic print output which rivals the more expensive lithographic offset printer output.

As shown in FIG. 3, the large raised segment 9 and the small raised segment 10 are unchanged from FIGS. 2A–B. However, a very low percentage base dot screen provides dot screen points 12 which are placed in recessed areas of the flexographic printing plate 8. These dot screen points 12 are very small and represent a very small total area of the print surface 2. Due to their small total area, they do not have an appreciable effect on perceived color. However, they do have an effect on compression, because they distribute the force of the printing surface 2 against the flexographic printing plate 8 over a wider surface area. This results in a reduction in the compressive forces on the dots which in turn lessens the lateral expansion of those dots which results in reduced dot gain. This is illustrated in FIG. 3 by small raised segment 10 and the adjacent dot screen points 12. By having the dot screen points 12 near the small raised segment 10, the dot screen points 12 absorb some of the compressive force and reduce the lateral expansion of small raised segment 10. As a result, by adding additional dot screen points 12, which actually increase the total raised surface area contacting the printing surface 2, the total area which contacts the printing surface 2 is reduced due to the reduction in dot gain.

Figure 4A:
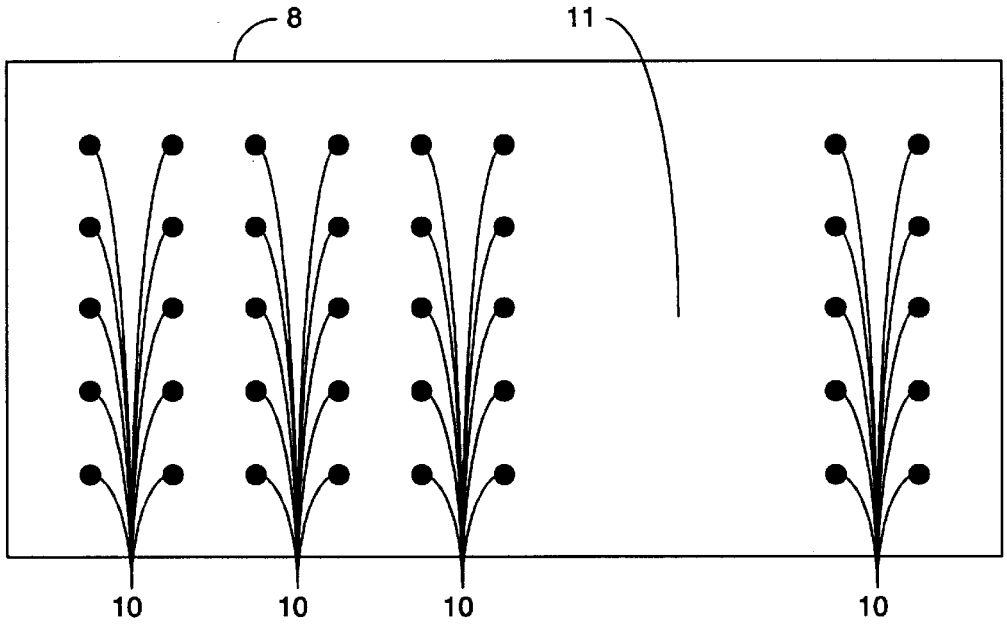
Figure 4A Prior Art
FIG. 4A is an illustration of a prior art flexographic plate showing small raised segments on a portion of the flexographic plate and a zero percentage area on another portion of the flexographic plate.
Figure 4B:
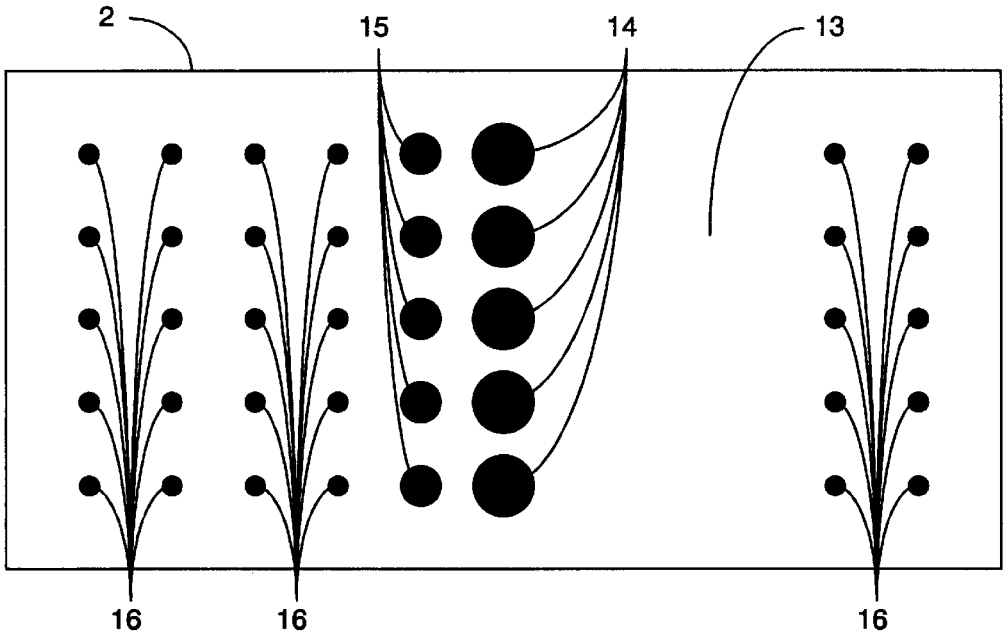
Figure 4B Prior Art
FIG. 4B is an illustration of a prior art printing surface illustrating the dot gain which results from the zero percentage area of the flexographic plate shown in FIG. 4A.

FIGS. 4A–B illustrate how the dot gain problem is created due to zero percentage areas 11 on a prior art flexographic plate 8. As the area of the flexographic plate 8 adjacent to a zero percentage area of the printing surface is printed, the small raised segments 10 nearest the zero percentage area 11 receive a disproportionate amount of pressure during the printing process. This causes the flexible material which forms the small raised segments 10 to compress and thereby expand. This expansion results in increased dot size on the printing surface 2. In turn, the increased dot size can distort the print image's color, and/or distort the print images brightness or darkness, which results in a poorer quality image.

FIG. 4A is an illustration of a prior art flexographic plate 8 showing small raised segments 10 on a portion of the flexographic plate 8 and a zero percentage area 11 on another portion of the flexographic plate 8. As the zero percentage area 11 passes over the printing surface there is no pressure applied. As the flexographic plate 8 rotates the first small raised segments 10 adjacent to zero percentage area 11 of the first to come in contact with the printing surface 2 (shown in FIG. 4A). These small raised segments 10 will have the most pressure applied to them, and will therefore have the greatest amount of expansion (dot gain). As the flexographic plate 8 continues to rotate, additional small raised segments 10 will come in contact with the printing surface 2, but the preceding small raised segments 10 will have already been absorbing some of pressure and therefore the dot gain will be less.

FIG. 4B is an illustration of a prior art printing surface illustrating the dot gain which results from the zero percentage area 11 of the flexographic plate 8 shown in FIG. 4A. In this figure, the first small raised segments 10 on the flexographic plate 8 which are adjacent to the zero percentage area 11 will result in significant dot gain as shown by large dots 14. As the flexographic plate 8 rotates, medium-size dots 15 will be created which exhibit less dot gain due to the pressure absorbed by the first small raised segments 10 which previously contacted the printing surface 2. As the flexographic plate 8 continues to rotate, correctly size dots 16 are created as the printing pressure is once again evenly applied.

Figure 5A:
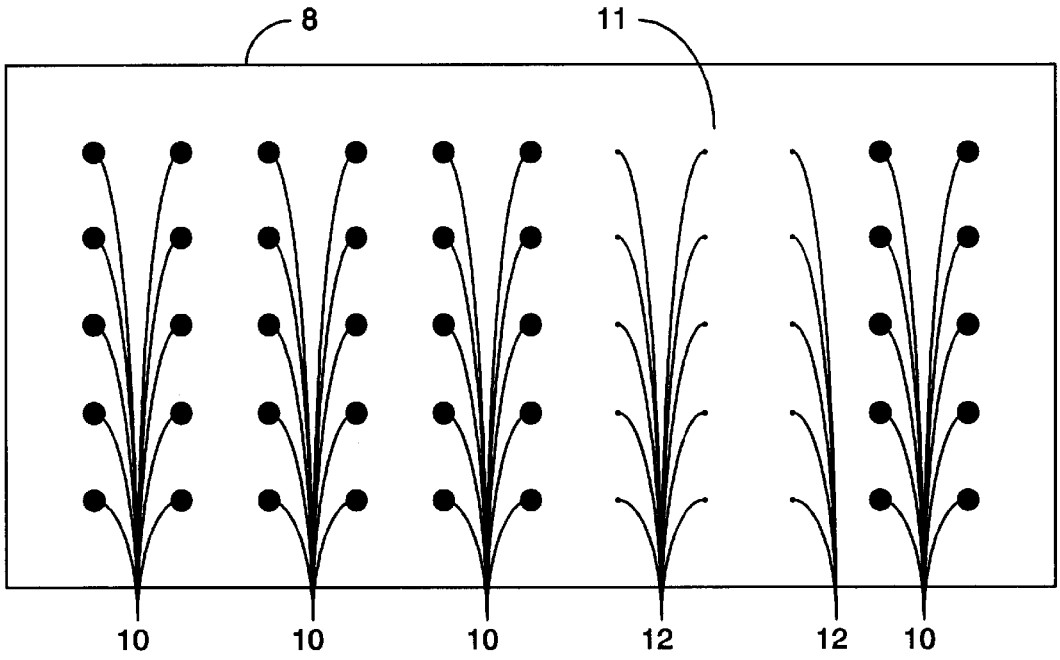
FIG. 5A illustrates a flexographic plate which uses a low percentage dot screen to eliminate zero percentage areas on the flexographic plate.

FIG. 5A illustrates a flexographic plate 8 which uses a low percentage dot screen 13 to eliminate zero percentage areas on the flexographic plate 8. The low percentage dot screen 13 is created by a field of dot screen points 12 which are distributed across what would have been a zero percentage area. The dot screen points 12 provide sufficient support against the printing surface 2 (shown in FIG. 5B) to significantly reduce the dot gain in the small raised segments 10 which would have been adjacent to the zero percentage area in the absence of the dot screen points 12. In the preferred embodiment, the dot screen points 12 provide a contact area within a low percentage dot screen 13 which is less than fifteen percent of the total surface area of the low percentage dot screen 13. It has been found that a series of low percentage dots provides sufficient support to eliminate the dot gain problem, but does not degrade the image on the printing surface 2 due to the small amount of image data applied to the printing surface 2 by the dot screen points 12.

Those skilled in the art will realize that while the percentage of area covered by the dot screen points 12 in the preferred embodiment is fifteen percent or less of the total zero percentage area 11, the percentage of area used by the dot screen points 12 can vary, based on flexographic printing plate 8 material and applied pressure, so long as the dot screen points: a) are not too small to provide sufficient support to avoid unnecessary compression of the small raised segments 10 adjacent to the zero percentage area, and b) are not too large such that they print on the printing surface 2 in a manner that would be noticeable and/or degrade the image.

Figure 5B:
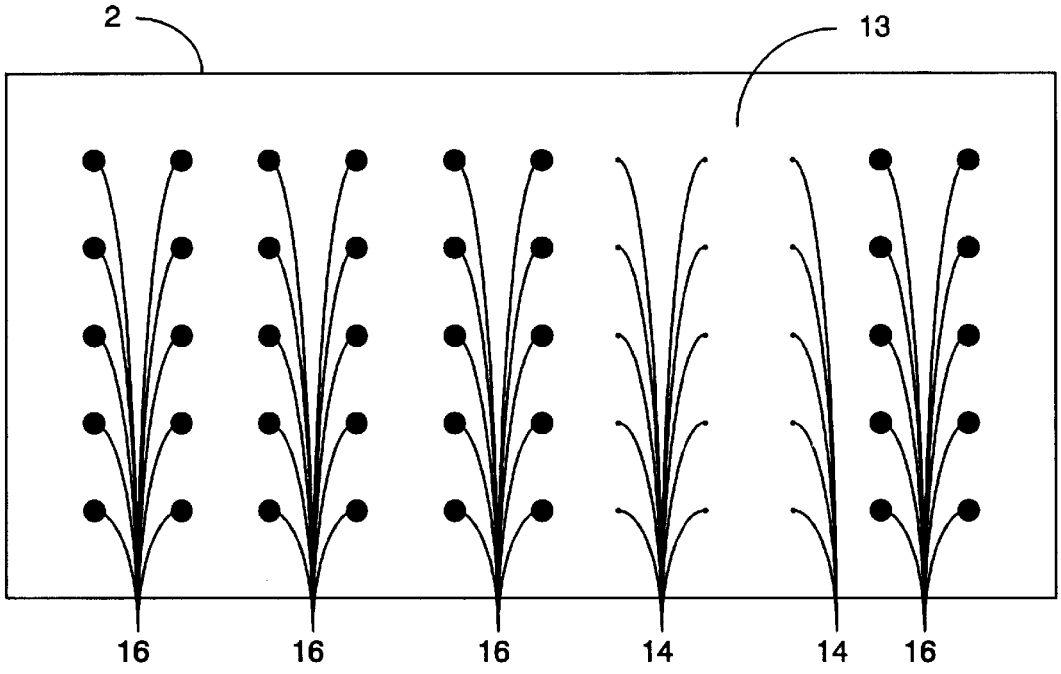
FIG. 5B illustrates a printing surface created from the flexographic plate of FIG. 5A in which the dot gain is eliminated by pressure absorbed by the low percentage dot screen.

FIG. 5B illustrates a printing surface 2 created from the flexographic plate 8 of FIG. 5A in which the dot gain is eliminated by pressure absorbed by the low percentage dot screen 13. In this figure, the dot screen points 12 produced very small dots 14 on the printing surface 2. However, due to the very small percentage of area covered by the very small dots 14, they are not noticeable when viewed. However they do provide sufficient support for the flexographic printing plate 8 (shown in FIG. 5A) to substantially reduce the dot gain created by the prior art. As can be seen, the low percentage dot screen 13 results in a printing surface 2 which has correctly sized dots 16 which are proportional to the small raised segments 10, and which do not exhibit dot gain.

In the preferred embodiment, the low percentage dots will be placed everywhere on the plate where the dot density would normally be zero percent. These dots will usually be equally spaced as most present technology uses equally sized dots for a given screen percentage. However, those skilled in the art will recognize that there are newer technologies (e.g. stochastic printing, for one) which use different sized dots to achieve a given screen percentage. As a result, the exact placement and size of the dots can vary so long as they are sufficient to reduce the problem of dot compression.

While the invention has been described with respect to a preferred embodiment thereof, it will be understood by those skilled in the art that various changes in detail may be made therein without departing from the spirit, scope, and teaching of the invention. For example, the material used to construct the flexographic printing plates may be anything suitable for its purpose, the size and shape of the shape of the dot screen points can vary, etc. Accordingly, the invention herein disclosed is to be limited only as specified in the following claims.

I claim:

1. A flexographic printing plate, comprising:

at least one raised segment on the surface of the flexographic printing plate;

at least one zero percentage area on the surface of the flexographic printing plate, the zero percentage area having substantially no raised segments; and a dot screen, the dot screen further comprising a plurality of dot screen points located on the zero percentage area, the dot screen points having a surface area substantially smaller than a raised segment, and having an elevation substantially the same as the raised segment;

whereby the dot screen distributes pressure on the flexographic plate when in use such that compression of the raised segment is reduced during printing.

2. A flexographic printing plate, as in claim 1, wherein:

the dot screen points are substantially uniform in size.

3. A flexographic printing plate, as in claim 2, wherein:

the dot screen points are distributed into a substantially uniform pattern in the zero percentage area.

4. A flexographic printing plate, as in claim 2, wherein:

the dot screen points are distributed into a substantially random pattern in the zero percentage area.

5. A flexographic printing plate, as in claim 1, wherein:

the dot screen points are random in size.

6. A flexographic printing plate, as in claim 5, wherein:

the dot screen points are distributed into a substantially uniform pattern in the zero percentage area.

7. A flexographic printing plate, as in claim 5, wherein:

the dot screen points are distributed into a substantially random pattern in the zero percentage area.

8. A flexographic printing plate, as in claim 1, wherein:

the dot screen points are less than or equal to fifteen percent of the area of the zero percentage area;

whereby the dot screen points minimize dot gain by providing a surface area to distribute pressure applied by the flexographic printing plate.

9. A method of fabricating a reduced dot gain flexographic printing plate, including the steps of:

forming at least one raised segment on the surface of the flexographic printing plate;

identifying at least one zero percentage area on the surface of the flexographic printing plate that has substantially no raised segments; and forming, in the zero percentage area, a dot screen that is comprised of a plurality of dot screen points, the dot screen points having a surface area substantially smaller than a raised segment, and having an elevation substantially the same as the raised segment.

10. A method, as in claim 9, including the additional step of:

forming the dot screen points such that they are substantially uniform in size.

11. A method, as in claim 10, including the additional step of:

distributing the dot screen points in a substantially uniform pattern in the zero percentage area.

12. A method, as in claim 10, including the additional step of:

distributing the dot screen points in a substantially random pattern in the zero percentage area.

13. A method, as in claim 9, including the additional step of:

forming the dot screen points such that they are substantially random in size.

14. A method, as in claim 13, including the additional step of:

distributing the dot screen points and a substantially uniform pattern in the zero percentage area.

15. A method, as in claim 13, including the additional step of:

distributing the dot screen points in a substantially random pattern in the zero percentage area.

16. A method, as in claim 9, including the additional step of:

selecting the number of dot screen points such that they cumulatively cover less than or equal to fifteen percent of the zero percentage area.

17. A method of reducing dot gain in flexographic printing, including the steps of:

forming a print image with raised segments on a flexographic plate;

identifying at least one zero percentage area on a flexographic printing plate in which there are substantially no raised segments;

distributing force placed against the raise segments by placing a dot screen in the zero percentage area, the dot screen is formed by multiple dot screen points, and having an elevation substantially the same as the raised segment; and using the dot screen to distribute force applied by the flexographic printing plate onto a printing surface such that raised segments adjacent to other raised segments are compressed substantially the same amount as raised segments which are not adjacent to other raised segments;

whereby dot gain created by excessive compression of raised segments adjacent the zero percentage area is reduced by distributing the compressor force of the flexographic plate across the dot screen.

18. A method, as in claim 17, including the additional step of:

selecting the number of dot screen points such that they cumulatively cover less than or equal to fifteen percent of the zero percentage area.

19. A method, as in claim 18, including the additional step of:

distributing the dot screen points in a substantially uniform pattern in the zero percentage area.

20. A method, as in claim 18, including the additional step of:

distributing the dot screen points in a substantially random pattern in the zero percentage area.

* * * * *